United States Patent [19]

Ward, II

[11] Patent Number: 4,894,887

[45] Date of Patent: Jan. 23, 1990

[54] EYEGLASS RETAINER

[75] Inventor: Seth Ward, II, Little Rock, Ark.

[73] Assignee: POM Incorporated, Russellville, Ark.

[21] Appl. No.: 136,112

[22] Filed: Dec. 21, 1987

Related U.S. Application Data

[63] Continuation of Ser. No. 941,304, Dec. 12, 1986, abandoned.

[51] Int. Cl.[4] ..... A44B 21/00

[52] U.S. Cl. ..... 24/3 C; 24/3 F; 24/3 L

[58] Field of Search ..... 24/3 R, 3 C, 3 D, 3 G, 24/3 H, 3 J, 3 K, 3 L, 3 F; 224/251

[56] References Cited

U.S. PATENT DOCUMENTS

| | | | |
|---|---|---|---|
| 484,335 | 10/1892 | Moss | 224/251 X |
| 1,206,074 | 11/1916 | Zwiener et al. | 24/3 K |
| 3,148,812 | 9/1964 | Hilsinger, Jr. | 24/3 C |
| 4,458,384 | 7/1984 | Arnold | 24/3 C |

FOREIGN PATENT DOCUMENTS

| | | | |
|---|---|---|---|
| 28981 | 5/1981 | European Pat. Off. | 24/3 C |

*Primary Examiner*—James R. Brittain

[57] ABSTRACT

An eyeglass retaining carrier device which is clipped to the clothing of an eyeglass wearer for supporting and maintaining a pair of eyeglasses, by one of its temple sidepieces, in a substantially downward suspended inclination.

10 Claims, 1 Drawing Sheet

EYEGLASS RETAINER

This application is a continuation of my application Ser. No. 941,304 filed December 12, 1986 and now abandoned.

BACKGROUND OF THE INVENTION

1. Field of the Invention

The present invention relates to a retaining carrier device for eyeglasses and more particularly to an inconspicuous eyeglass retainer which is adapted to be clipped on clothing of an eyeglass wearer for pendulously supporting a pair of eyeglasses.

2. Description of the Prior Art

Eyeglasses, when not worn, are frequently carried in a bulk case or pouch for protection and may be placed in a pocket or handbag. When the glasses are frequently put on and taken off, it is desirable to have the glasses more easily and quickly accessible. Herein, the glasses may be hung in front of the user by an elastic cord encircling the neck and attached to the end portions of each temple piece. This is somewhat unsatisfactory for carrying the eyeglasses as they remain opened and rest against the chest of the wearer. Herein, especially with an active person, the eyeglasses may swing about excessively and be damaged as well as interfere with or restrict a person's movements. More frequently, people tend to merely fold up their eyeglasses and slip them into a shirt or coat pocket. The loose eyeglasses thereupon may be scratched by other material carried in the pockets or may fall out and be broken.

Accordingly, an eyeglass retainer which will support the eyeglasses in a safe, accessible and compact manner would be a decided advance in the state of the art.

SUMMARY OF THE INVENTION

This invention provides a small, secure and convenient carrying device for eyeglasses which may be clipped on the clothing of an eyeglass user. Herein, a pair of interconnected, downward extending fingers provide a clip-on connection to a shirt or coat pocket or a belt, with an integral loop portion arranged to accommodate one of the temple sidepieces of a pair of eyeglasses. The looped opening is of a suitable size to support and retain the eyeglasses in a controlled pendulous manner. Preferably, the looped opening has a vertical length of approximately 1/15th of the eyeglass temple sidepiece; a front to back depth generally equal to the opening length and a side-to-side length of about two and one half times the opening length.

Preferably, the carrying device is made of a synthetic material providing a degree of resilience such that the fingers may be slightly separated for attachment to the eyeglass user's clothing and provide a clamping grip thereto when released.

Because of the pendulous nature of the eyeglass support, even though the user bends over the glasses will still assume a substantially downward inclination and thereby be retained in the device through a wide variety of body positions of the eyeglass user.

Accordingly, it is a primary object of this invention to provide an inconspicuous carrying device for eyeglasses which can be conveniently attached to the clothing of an eyeglass user and which will securely support the glasses regardless of the user's body movement effecting the orientation of the device.

Another object of this invention is to provide an eyeglass retainer in which the eyeglasses maintain a substantially downward inclination regardless of the orientation of the retainer.

The above and further features of the invention will be better understood with respect to the following detailed description of the preferred embodiment considered in combination with the several figures of the accompanying drawings.

DESCRIPTION OF THE PREFERRED EMBODIMENT

Figure 1:
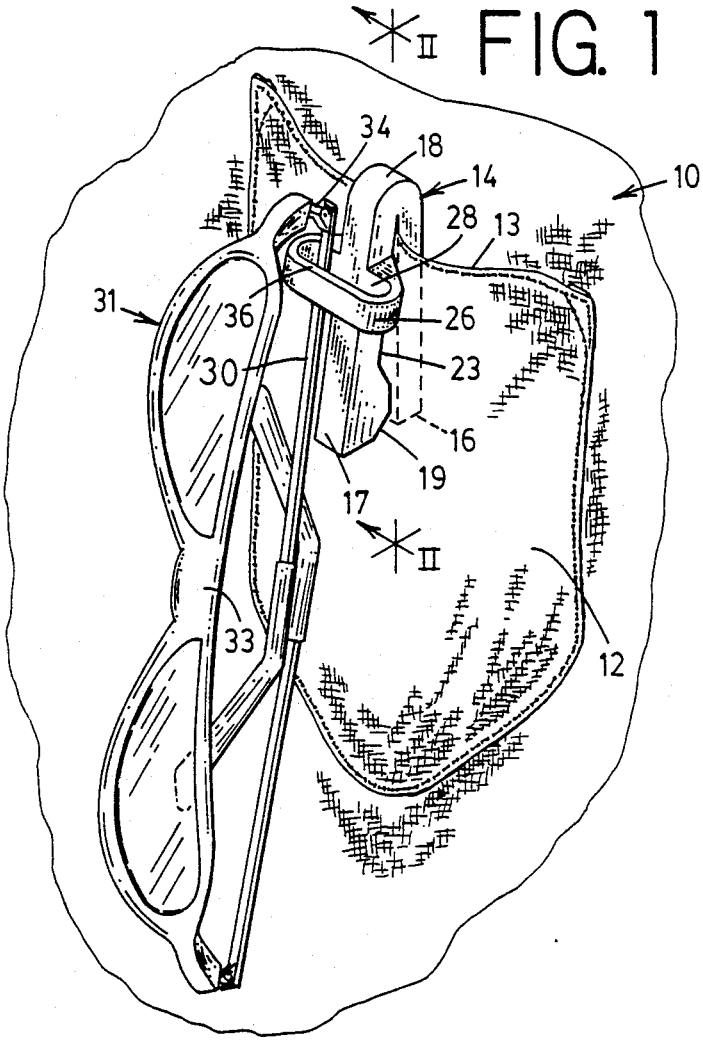
FIG. 1 is a perspective view of an eyeglass carrying device clipped onto a shirt pocket and supporting the glasses in a loosely downward hanging position.

In FIG. 1, there is shown a fragmentary portion of an eyeglass wearer's clothing as, for example, a shirt 10 having a pocket 12 attached thereto and having an open upper edge 13. An eyeglass retainer 14 is supported from the pocket edge 13 with a suitable holding force to prevent it from being dislodged. The retainer 14 includes a pair of downwardly extending finger members 16 and 17 which are interconnected at an upper region 18. The finger members are arranged in an opposing relationship and are preferably constructed of synthetic resilient material which will provide a biasing force to clamp the eyeglass retainer to the shirt pocket as best seen in FIG. 1. Obviously, the retainer may be attached to the clothing at any convenient suitable lcoation.

Figure 2:
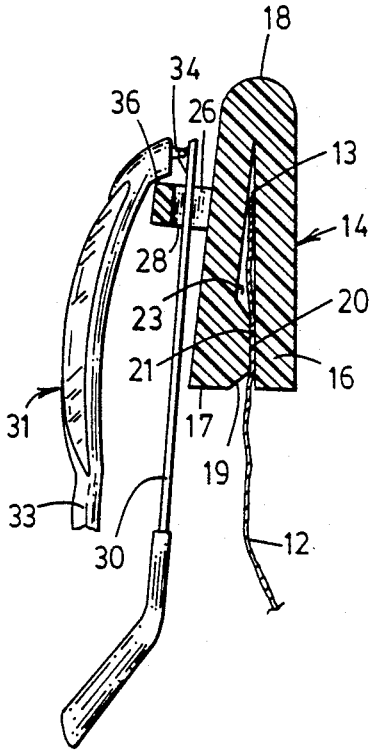
FIG. 2 is an enlarged vertical sectional view taken generally along the line II—II of FIG. 1.
Figure 3:
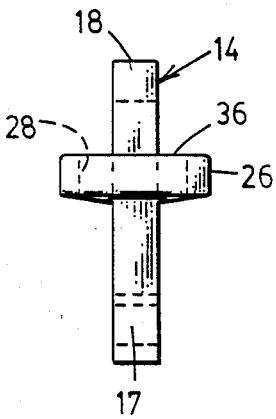
FIG. 3 is a front elevational view of the eyeglass carrying device shown in FIG. 1.
Figure 4:
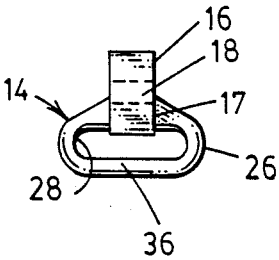
FIG. 4 is a top plan view of the eyeglass carrying device.
Figure 5:
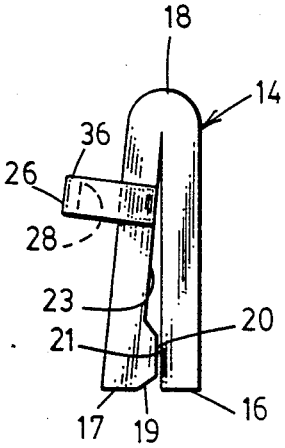
FIG. 5 is a side elevational view of the device.

As best seen in FIGS. 2 and 5, the finger 17 is provided with a lead-in bevel 19 to facilitate insertion of the pocket edge 18 and wherein the fingers will yieldably slightly separate to permit the pocket edge 13 to pass between the fingers 16 and 17. A clamping face 20, adjacent the distal end of the finger 17, provides a biased surface to firmly press the pocket material against a cooperating face 21 on distal end of the finger 16. An enlarged passageway 23 extends upward from the clamping faces 20 and 21 to enhance the passage of the pocket material into the upper region 18.

The retainer 14 further includes a transverse looped hanger portion 26 formed integral with the finger 17, midway between the upper region 18 and the distal end. The looped hanger portion 26 provides an elongated opening 28 adapted to loosely receive a temple sidepiece 30 of a pair of eyeglasses 31. The temple piece 30 is folded down against the eyeglass frame 33 and slipped through the opening 28 to the point where the hinge 34 or the frame portion adjacent the hinge comes to rest on a top support edge 36 of the hanger portion 26. The opening 28 is sufficiently large to receive a variety of temple sidepiece sizes and retain the glasses in a pendulous supporting relationship. Herein, the eyeglasses are maintained suspended in a substantially downward inclination at all times. That is, even when the eyeglass user bends over, thereby placing the retainer 14 in a generally horizontal position, the eyeglasses will shift about in the opening 28 to maintain a substantially downward suspended position. Even with excessive bending over the glasses will shift to a maximum allowable extent whereby the temple piece will wedge in the opening 28 thus being prevented from sliding out of the retainer 14. When the glasses are to be used again, the temple piece 30 is simply lifted upward free of the hanger portion 26 and positioned on the head of the eyeglass user.

Thus, it will be seen that the present invention not only provides a convenient accessible way of carrying eyeglasses when not being used but further insures that the glasses will not slip out of the carrying device and become scratched or broken.

While a specific preferred embodiment of the invention has been described, it will be recognized by those skilled in the art that variations may be made without departing from the spirit and scope of the invention, as described in the appended claims.

I claim:

1. A pair of eyeglasses and an eyeglass retainer for supporting the pair of flat folded eyeglasses from clothing of an eyeglass user comprising:

a pair of eyeglasses including an eyeglass frame and lens, the eyeglass frame including a pair of temple sidepieces for supporting the eyeglasses on the head of the user;

the eyeglass retainer including a clip portion having first and second elongated finger members arranged in opposing relationship and being interconnected to an upper region with downward extending distal ends which are resiliently biased together to clip on clothing of an eyeglass user, the eyeglass retainer further including a nonflaccid transverse looped hanger portion formed integral wth said first finger member and extending outwardly therefrom, the hanger portion being disposed intermediate the upper region and said distal end of said clip portion and adapted to receive the temple sidepiece of the pair of eyeglasses, and means associated with said hanger portion to support and maintain the eyeglasses in a controlled pendulous orientation comprising a substantially oval cross-sectional shaped opening extending vertically through said hanger portion with a support edge for abutting a portion of the eyeglasses the opening and support edge cooperating with the temple sidepiece, said opening having a side-to-side width; a front-to-back depth and a top-to-bottom length in which the length of the opening is generally equal to the depth of the opening to accommodate limited forward and backward movement of the eyeglasses relative to said hanger portion of the eyeglass retainer wherein the eyeglasses are maintained in a substantially downward suspended inclination.

2. The eyeglass retainer in accordance with claim 1, wherein said first finger member of said clip portion is provided with a lead-in bevel to facilitate insertion of the clothing between the distal ends of said finger members.

3. The eyeglass retainer in accordance with claim 2, wherein opposing distal ends of the finger members include clamping faces to secure the eyeglass user's clothing therebetween.

4. The eyeglass retainer in accordance with claim 3, wherein an enlarged passageway is formed above said clamping faces to accommodate movement of the clothing into said upper region.

5. The eyeglass retainer of claim 1 wherein the width of the opening in the hanger portion is about two and one half times the length to facilitate limited side-to-side movement of the eyeglasses.

6. The eyeglass retainer in accordance with claim 1, wherein said first finger member of said clip portion is provided with a lead-in bevel to facilitate insertion of a portion of the clothing between the distal ends of said finger members.

7. The eyeglass retainer in accordance with claim 6, wherein opposing distal ends of the finger members include clamping faces to secure the eyeglass user's clothing therebetween.

8. The eyeglass retainer in accordance with claim 7, wherein an enlarged passageway is formed above said clamping faces to accommodate movement of the clothing into said upper region.

9. An eyeglass retainer for supporting a pair of flat folded eyeglasses comprising:

a pair of eyeglasses including an eyeglass frame and lens, the eyeglass frame including a pair of temple sidepieces for supporting the eyeglasses on the head of the user;

a pair of resilient finger members secured together at a first end of each, each finger extending downwardly in a vertical direction to a second end, the finger members having a substantially similar vertical length, the second ends of each finger defining a clamping face, the fingers defining between the first and second end of each a channel, the second end of each finger being yieldingly separable to allow a portion of an article to which the eyeglass retainer is secured to be received within the channel, a first one of the fingers including a bevel for facilitating insertion of the portion of the article in the channel;

a nonflaccid hanger member extending outwardly in a first direction from the first finger, the hanger member having a vertical length substantially less than the vertical length of the first finger and being located between the first end and the second end of the first finger, the hanger member defining an opening for receiving a temple sidepiece of the pair of glasses, said opening having a substantially oval cross-sectional shape and having a vertical length of approximately 1/15 of the length of said temple sidepieces, and a front to back depth generally equal to the opening length to allow sideways, and forward and backward movement of the eyeglasses with respect to the hanger member while retaining the temple sidepiece in the opening of the hanger, the pair of legs and hanger member cooperating to maintain the eyeglasses in a substantially downwardly vertical position when the retainer is moved from a first position wherein said fingers extend vertically downward to a second position wherein said fingers do not extend vertically downward.

10. The eyeglass retainer of claim 9 wherein the retainer is constructed from a resilient material.

* * * * *